US006557641B2

(12) United States Patent
Sipos et al.

(10) Patent No.: US 6,557,641 B2
(45) Date of Patent: May 6, 2003

(54) MODULAR WELLBORE TUBULAR HANDLING SYSTEM AND METHOD

(75) Inventors: David L. Sipos, Youngsville, LA (US); Donald E. Mosing, Lafayette, LA (US)

(73) Assignee: Frank's Casing Crew & Rental Tools, Inc., Lafayette, LA (US)

( * ) Notice: Subject to any disclaimer, the term of this patent is extended or adjusted under 35 U.S.C. 154(b) by 0 days.

(21) Appl. No.: 09/853,007

(22) Filed: May 10, 2001

(65) Prior Publication Data

US 2002/0166669 A1 Nov. 14, 2002

(51) Int. Cl.[7] ..... E21B 19/16

(52) U.S. Cl. ..... 166/380; 166/77.1; 166/77.52; 166/85.1

(58) Field of Search ..... 166/77.1, 77.52, 166/77.53, 85.1, 75.14, 379, 380; 254/29 R, 30

(56) References Cited

U.S. PATENT DOCUMENTS 4,595,062 A * 6/1986 Boyadjieff et al. ..... 166/379

5,909,768 A * 6/1999 Castille et al. ..... 166/77.1

* cited by examiner

*Primary Examiner*—David Bagnell
*Assistant Examiner*—Zakiya Walker
(74) *Attorney, Agent, or Firm*—The Matthews Firm

(57) ABSTRACT

A wellbore tubular handling system and method is provided for operation in holding and lowering tubulars, such as casing strings, at a rig site. The handling system utilizes a plurality of interchangeable gripping modules for use with both the elevator slips and the spider. Because the gripping modules are completely interchangeable, only one additional gripping module is needed to provide redundancy at the well site to thereby reduce the equipment normally required. An elevator module receives the interchangeable gripping module therein. An interchangeable gripping module may also preferably be flush mounted in many standard rotary table types. Alternatively a top mount spider module is provided to receive a gripping module for other rig floor and/or rotary table constructions. The gripping module has three inner support rings and slips between approximately one and two feet in length to permit load support while protecting any thin walled casing that is used in the casing string.

26 Claims, 6 Drawing Sheets

100
74
60
122
126
114
68
124
118
116
78
60
128
130
112
54
110

MODULAR WELLBORE TUBULAR HANDLING SYSTEM AND METHOD

BACKGROUND OF THE INVENTION

1. Field of the Invention

The present invention relates generally to installing or running wellbore tubulars such as casing into a wellbore and, more particularly, to a modular handling tool system for holding and lowering the wellbore tubulars into the wellbore.

2. Description of the Background

A string of wellbore tubulars such as casing, depending on the length and type of tubular elements, may weigh hundreds of thousands of pounds. Despite this significant weight, the casing string must be carefully controlled as it is interconnected and lowered into the wellbore. To further complicate this function, wellbore tubulars, such as casing, come in a wide range of diameters and weights. In some cases, the casing may have a relatively thin wall that can be crushed if too much force is applied thereto.

Pneumatic and/or hydraulic casing tools are large gripping devices used for holding and lowering the wellbore tubulars, such as casing, into the previously drilled open hole. These gripping tools may weigh several tons depending on the size and type of slips used therein. The casing tools are typically used in sets comprising one elevator slip assembly and one spider slip assembly. The elevators slip assembly is translationally moveable with respect to the spider slip assembly. The elevator slip assembly is carried by the traveling block. The spider slip assembly may be a flush mount spider used on the drill floor with a rotary drive such as by replacing the master bushing. On the other hand, the spider assembly construction may need to provide a top mount spider that is mounted on the top of the rotary table or drill floor and which may be used with a scaffold or the like. Pneumatic and/or hydraulic control equipment is provided to operate the slips in the elevator slips assembly and in the spider assembly. Numerous pneumatic/hydraulic control lines are used to interconnect and operate the elevator slips assembly and the spider assembly.

To limit any downtime costs due to damage, maintenance, or repairs, it is generally desirable to provide on the rig site location backup or redundant gripping tools for both the elevator slip assembly and also for the type of spider slip assembly used. Thus, at least four tools are generally necessary at the rig site. The rental costs for having four large, rather complicated, tools on location can be substantial although such costs are preferable to the possibility of having one tool damaged without a spare on location. Due to the size and availability, considerable time may be needed to obtain a replacement. To save costs, it would be desirable to reduce such redundancy requirements while still maintaining the system reliability afforded by 100% redundancy.

Various prior art exists that is related to such gripping tools including U.S. Pat. No. 5,909,768, issued Jun. 8, 1999, to Castille et al., which discloses an exemplary apparatus for optimally gripping and releasing a tube. The apparatus has an elevator with a set of slips for optionally gripping and releasing a tube and a spider with a set of slips for optionally gripping and releasing the end of the tube. The elevator and spider slips are in communication with each other by pressurized conduits. The conduits form a pressure circuit to supply pressure to release one set of slips only when the other set of slips is gripping the tube, wherein the apparatus has improved response time. The spider may be hydraulically or pneumatically actuated and the elevator may be pneumatically operated. The spider may be flush mounted.

Other prior art patents may include U.S. Pat. Nos. 3,215,203; 3,708,020; 3,722,603; 4,676,312; 4,842,058, and 5,343,962.

The above referenced prior art does not disclose means for eliminating the need for having two backup tools at the rig site. It would be desirable to provide 100% redundancy for both the spider and the elevator without the need for two backup tools at the rig site. Eliminating even the fourth backup tool would clearly provide a significant 25% economy for both the vendor and the customer. Those skilled in the art have long sought and will appreciate the present invention which addresses these and other problems.

SUMMARY OF THE INVENTION

The present invention was designed to provide more efficient operation to thereby reduce drilling costs due to decreased equipment needs on location or in the provider's warehouse. Manufacturing costs are reduced due to lower cost of building duplicate items rather than multiple items. Therefore, it is an object of the present invention to provide an improved handling system for holding and lowering wellbore tubulars, especially large tubulars such as casing, into the wellbore.

Another object of the present invention is to provide a handling system with 100% redundancy using fewer components.

Yet another object of the present invention is to provide a handling system with few different components.

Yet another object of the present invention is to reduce storage costs.

A feature of the present invention is a plurality of interchangeable gripping sections.

An advantage of the present invention is reduced operational and manufacturing and storage costs.

These and other objects, features, and advantages of the present invention will become apparent from the drawings, the descriptions given herein, and the appended claims. However, the invention is not limited to these objects, features, and advantages.

Therefore, the present invention provides for a handling system for holding and lowering wellbore tubulars for use with a rig having a traveling block and a rig floor. The system comprises at least two gripping modules that may preferably be substantially identical so as to be interchangeable with each other. The at least two gripping modules each have a bowl section and each have a plurality of slips moveable within the bowl section. An elevator adaptor is provided that has at least one connector for coupling to the traveling block. The elevator adapter is attachable with either one of the at least two gripping modules while another of the at least two gripping modules may be attachable to the rig floor. The elevator adaptor preferably defines a bore therein for receiving either one of the at least two gripping modules. The connector for the elevator module may further comprise lifting ears.

A third gripping module may preferably be provided for use in substituting with either of the at least two gripping modules so as to provide system redundancy.

A top mount module may be mountable to the rig floor and is attachable to either of the at least two gripping modules. The top mount body preferably defines a bore therein for receiving either of the at least two gripping modules.

The at least two gripping modules each preferably have a weight supporting shoulder or flange or ring extending radially outwardly for supporting a weight of the wellbore tubulars. The elevator adaptor has an engagement surface for contacting the weight supporting shoulder of either of the at least two gripping modules.

A plurality of slips is preferably longitudinally moveable within each of the at least two gripping modules. A sloping bottom surface within each of the at least two gripping modules is angled with respect to an axis through each of the at least two gripping modules. The sloping surface forms a stop surface for supporting and preventing further longitudinal movement of the plurality of slips toward a gripping position.

Thus, a plurality of rings are preferably within each of the at least two gripping modules. A plurality of slips are provided for each of the at least two gripping modules with each slip having substantially sawtooth set of camming surfaces for camming engagement with the plurality of rings.

A method is for a wellbore tubular handling system for installing wellbore tubulars in a wellbore. The method may preferably comprise providing at least two gripping modules for gripping wellbore tubulars, selecting either of the at least two gripping modules for attachment to the traveling block, and selecting either of the at least two gripping modules for attachment to the rig floor. In one preferred embodiment, the method comprises supplying at least three gripping modules at the rig for gripping wellbore tubulars such that the at least three gripping modules are interchangeable for attachment to either the traveling block or the rig floor. One of the at least three gripping modules provides redundancy for the other two of the at least thee gripping modules. The attachment to the traveling block further comprises providing an elevator module for interconnection between the traveling block and either of the at least two gripping modules.

In one example of operation, the attachment to the rig floor further comprises a top mount module for interconnection between the rig floor and either of the at least two gripping modules. However, the attachment to the rig floor could also comprise a flush mount adaptor ring for interconnection between the rig floor and either of the at least two gripping modules.

In operation, the method may typically comprise providing at least three gripping modules that are substantially identical so as to be interchangeable with each other, supplying the rig with the at least three gripping modules, and also supplying the rig with a tool for attaching any one of the three gripping modules for use with the traveling block.

Thus, one preferred embodiment of the handling system of the present invention comprises a plurality of identical or substantially identical gripping modules such that each of the plurality of gripping modules may be interchangeable with respect to each other. A first of the plurality of substantially identical gripping modules may be mountable to the traveling block. A second of the plurality of substantially identical gripping modules may be mounted such that the traveling block is translationally moveable with respect thereto for cooperation with the first of the plurality of substantially identical gripping modules in holding and lowering the wellbore tubulars. In one embodiment, an elevator/top mount module is provided that may be used either with the elevators or as a top mount module. Thus, the elevator/top mount module may be connectable to either the rig floor or to the traveling block. The elevator/top mount module may receive either the first or the second of the plurality of substantially identical gripping modules

While the present invention will be described in connection with presently preferred embodiments, it will be understood that it is not intended to limit the invention to those embodiments. On the contrary, it is intended to cover all alternatives, modifications, and equivalents included within the spirit of the invention.

DETAILED DESCRIPTION OF THE PREFERRED EMBODIMENTS

Figure 1:
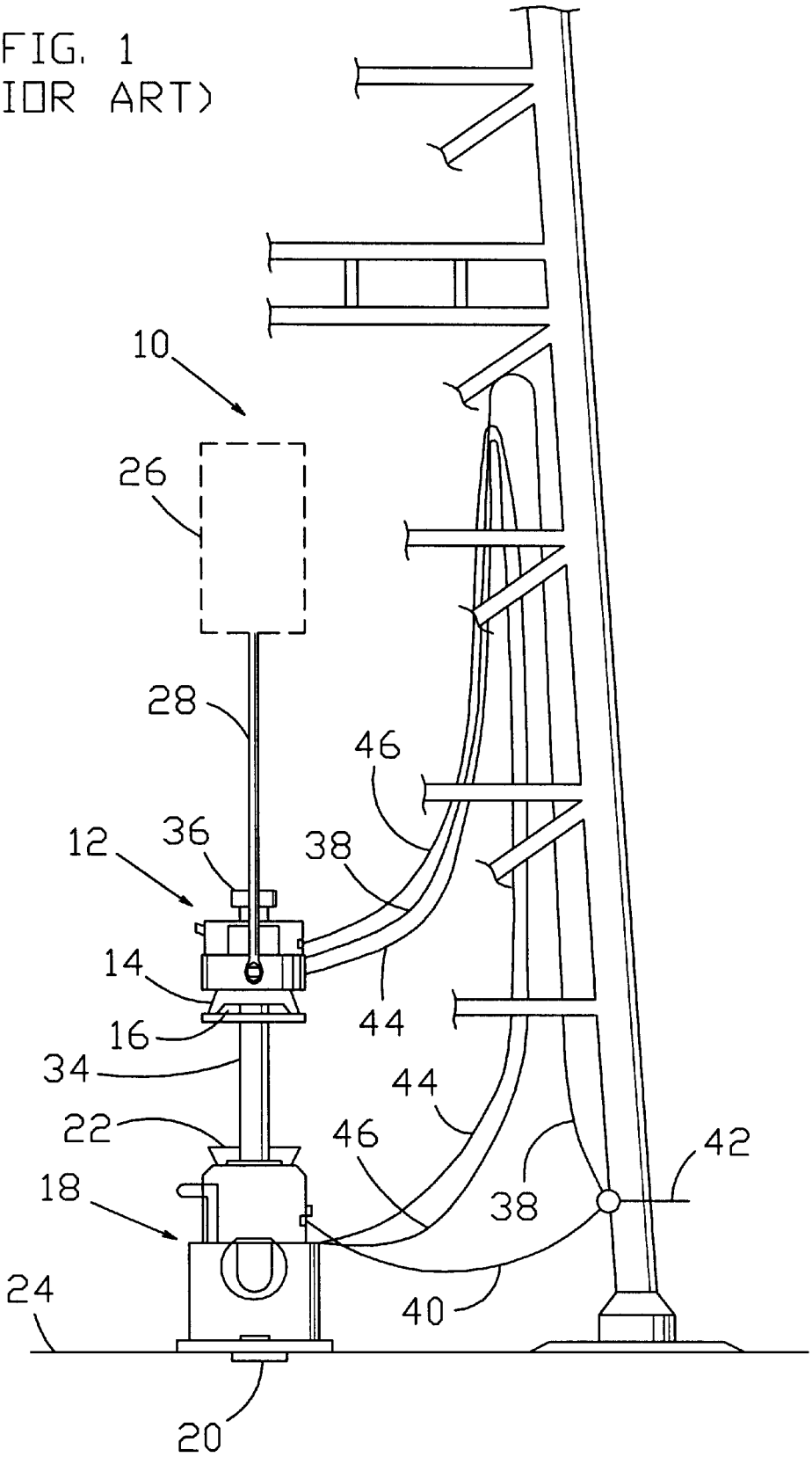
FIG. 1 (PRIOR ART)
FIG. 1 is a partial elevating view of a drilling rig showing an elevator supported by links from a traveling block and a spider slip assembly supported by the rig floor.

Referring first to FIG. 1 for general background, there is shown the pertinent portion of a drilling rig 10 which is rigged to run well casing with a prior art elevator slip assembly 12 suspended from links 28 and a traveling block 26 (indicated in dashed lines), having a bottom casing guide 16. Spider assembly 18 is mounted to rig floor 24 and may or may not have a bottom guide 20 and atop spider guide 22. Casing joint 34 is being assembled as part of a casing string. Casing joint 34 forms a type of wellbore tubular string which may typically be permanently cemented in place within an open hole wellbore. Casing joint 34 may typically have a collar 36 atone end thereof.

Also shown in FIG. 1, the elevator and spider may be of the type that is air actuated, or partially air actuated, from an air supply 42 which passes through a conduit or hose 38 to elevator 12 and through a conduit or hose 40 to the spider 18. Interconnected between the elevator 12 and the spider 18 are typically a plurality of conduits or hoses such as hoses or conduits 44 and 46.

Figure 2A:
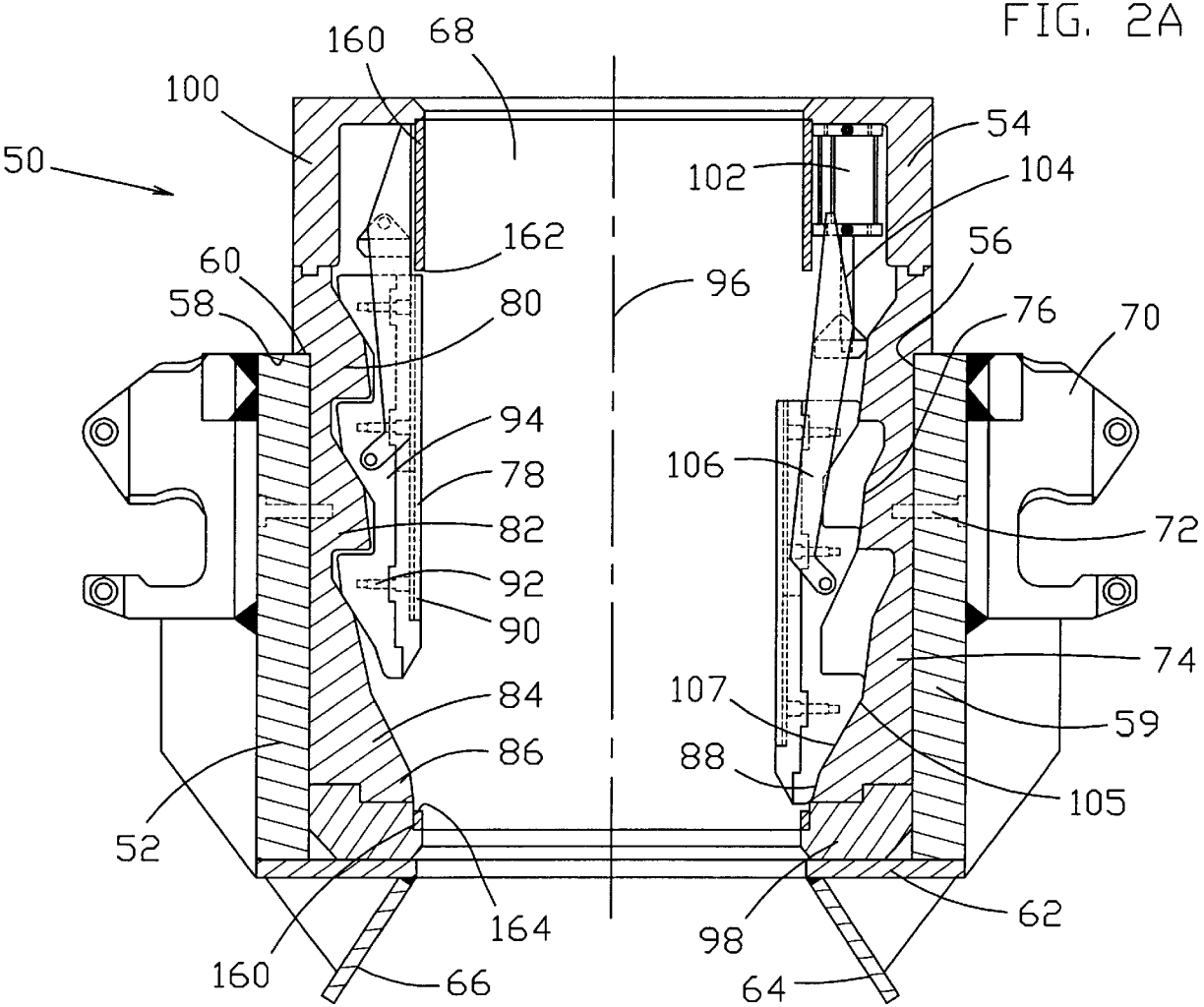
FIG. 2A is a split elevational view, partially in section, of an elevator module supporting an interchangeable gripping module.
Figure 2B:
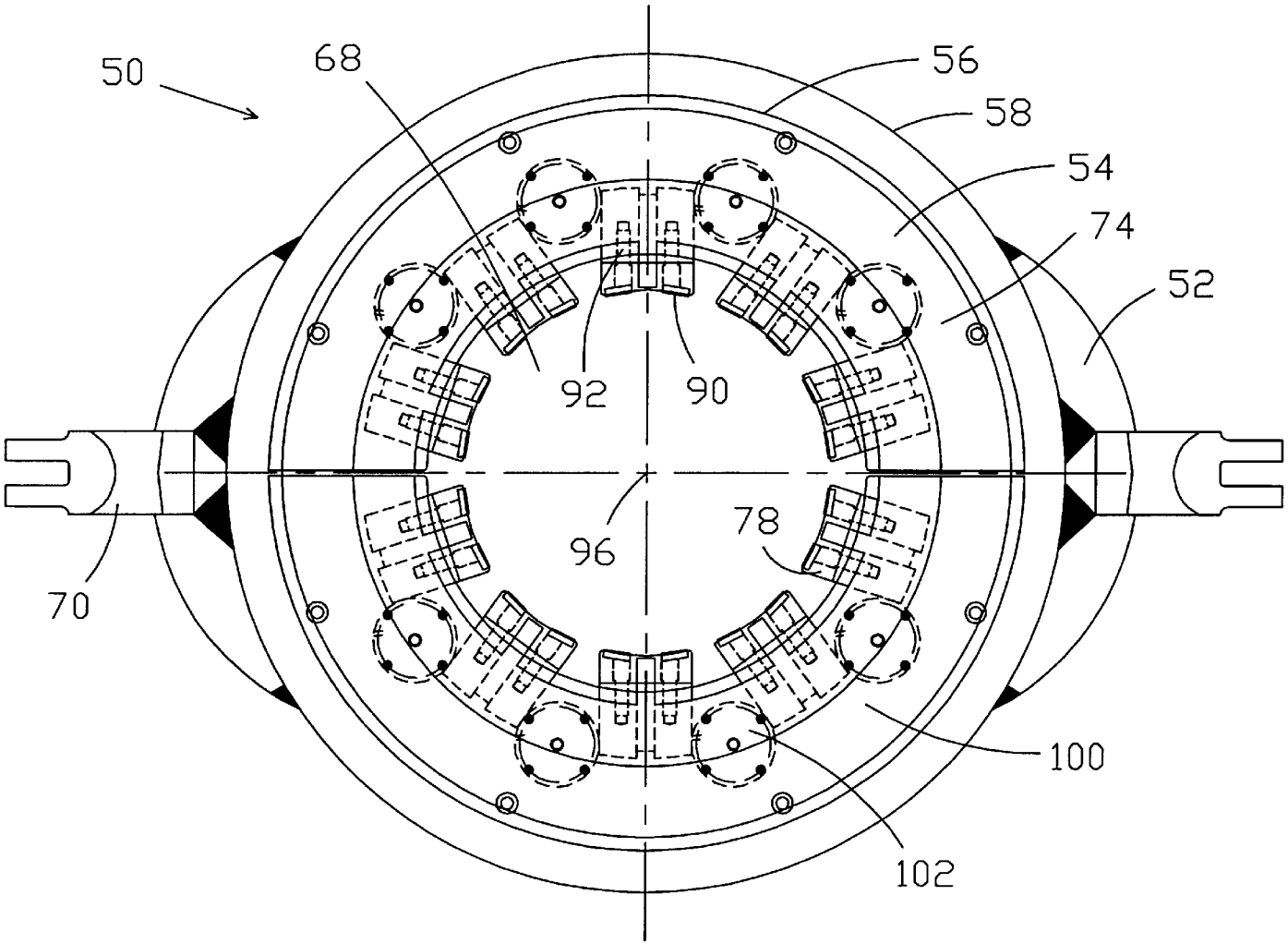
FIG. 2B is a top view, partially in section, of the elevator and interchangeable gripping module of FIG. 2A.

In FIG. 2A and FIG. 2B, slip-type elevator assembly 50 in accord with the present invention is disclosed. Slip-type elevator assembly 50 includes elevator module 52 and an interchangeable gripping module 54. In the handling system of the present invention, a plurality of interchangeable gripping modules 54 are used as discussed subsequently. Gripping module 54 is received into bore 56 of elevator module body 59. Bore 56 is preferably conveniently cylindrical for receiving a cylindrical mating portion of gripping module 54 below shoulder 60. The outer surface of elevator module body 59 may also preferably be cylindrical for lower manufacturing costs. Load supporting shoulder 60 of gripping module 54 engages load support surface 58 of elevator module 52 for supporting the heavy load of the casing string which may weigh hundreds of thousands of pounds. In a preferred embodiment, shoulder 60 is effectively formed by an increased diameter of gripping module 54 extending upwardly of load supporting shoulder 58 when gripping module 54 is positioned within elevator module 52 as illustrated in FIG. 2A. Other means besides load supporting shoulder 60 for supporting the weight may be provided such as bars, rings, flanges, and the like which could also be received by mating surfaces on elevator module 52.

Elevator module 52 may or may not include baseplate 62 which may be made integral to elevator module body 59. Casing guide 64 may be provided at the bottom of elevator module 52 with a sloped guide surface 66 for guiding the casing into gripping module bore 68. Elevator module has lifting ears 70 for connecting to links 28 that attach to traveling block 26. Bolts or other fasteners such as bolt 72 may be used for securing elevator module 52 with respect to gripping module 54.

Gripping module 54 includes a bowl section 74 with rings or sloping inner surfaces 76 that are used for supporting and urging camming slips 78 into and out of gripping arrangement with the casing, such as casing joint 34. Bowl section 74 may preferably be longitudinally split or in sections that are constrained or held together in operation by any one of elevator module 52, the rotary table bore, or top mount body 144 as discussed subsequently. In a presently preferred embodiment, bowl section 74 includes at least three internal load rings 80, 82, and 84 which form multiple camming surfaces. Using relatively long slips 78, very roughly between about one and two feet long, and supported by internal load rings 80, 82, and 84, the handling system of the present invention can handle full rated loads, up to for instance 500 tons, even without crushing thin wall tubulars. In a presently preferred embodiment, lower load ring 84 includes a separate support ring 86 that provides N additional strength by supporting slip 78 at end 88 as shown in the right half of the split view of FIG. 2A. The left side of FIG. 2A shows slips 78 in a non-gripping or retracted position while the right side of FIG. 2A shows slips 78 in the gripping or extended position.

Slips 78 include a slip shoe 90 which may be mounted by bolts 92 to a sliding support 94 which operates by cams or sloping surfaces of the load rings to move between the retracted (tubular released) and radially inwardly extended (tubular gripped) position as it slides longitudinally generally parallel to axis 96 of gripping module 54. In the split view of FIG. 2A, movement of sliding support 94 would be between the upward disengaged position (left split view), and the downward engaged position (right split view), respectively. An additional support ring 98 may be provided at the bottom of bowl section 74 to provide additional strength and support.

Gripping module 54 includes a slip operating mechanism which may be hydraulically or pneumatically controlled and is supported within upper housing section 100. A plurality of cylinders 102 are provided for operating mandrels 104. Mandrels 104 interconnect with control arms 106 which are pivotally connected to slips 78. Thus, upward and downward linear motion produced by cylinders 102 is used by camming surfaces, such as camming surfaces 105 on slips 78 and camming surfaces 107 on bowl section 74 to produce radially outwardly and radially inwardly movement of slips 78 for releasing and gripping wellbore tubulars such as casing joint 34. Preferably, camming surfaces 105 and 107 have a substantially sawtooth profile due to their being several rows to permit spreading the camming pressures over numerous camming surfaces. Thus, each gripping module 54 includes a bowl section 74, slips 78, and a slip operating mechanism.

Figure 3:
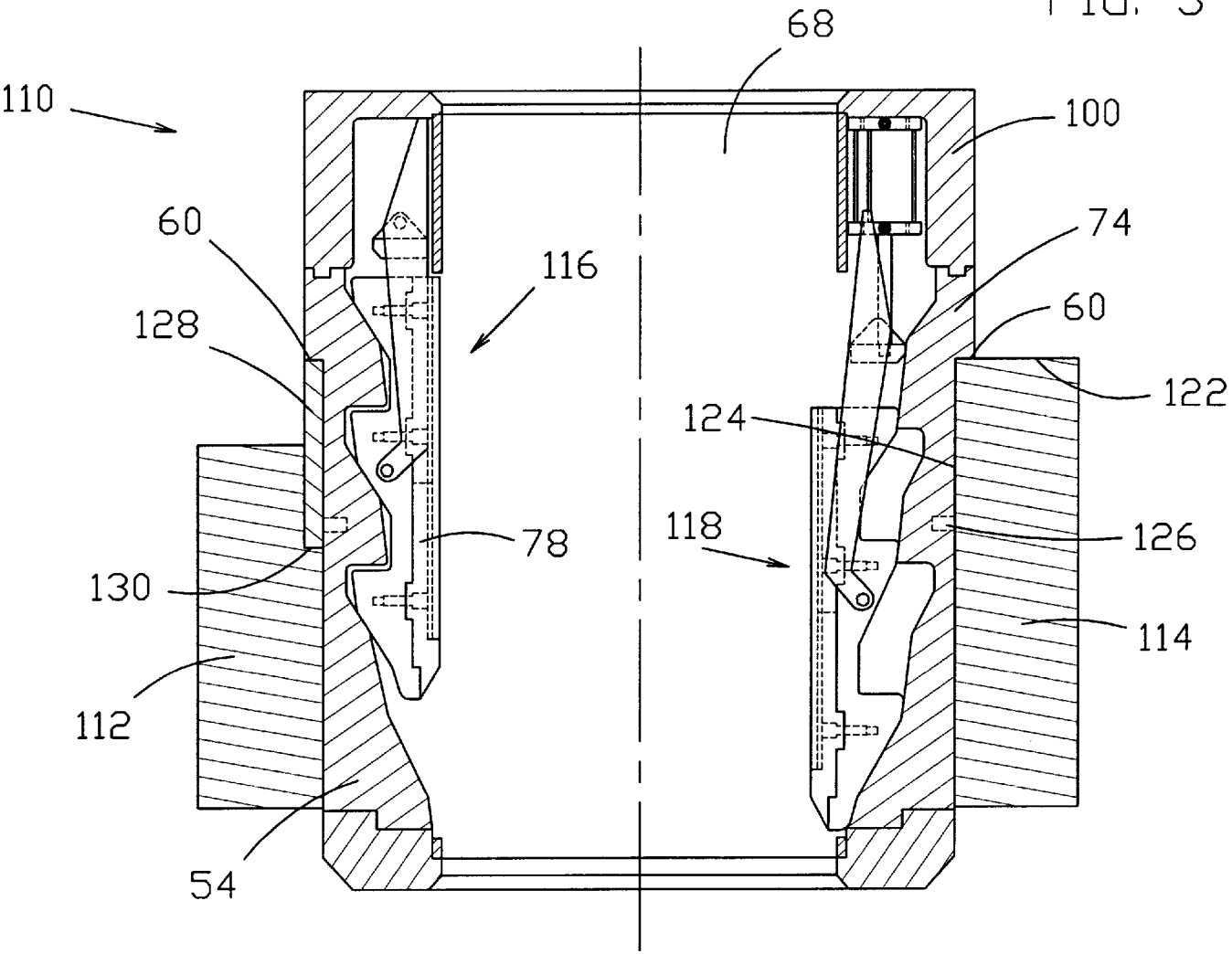
FIG. 3 is a split elevational view, in section, of a flush mounted interchangeable gripping module.

FIG. 3 shows an interchangeable gripping module 54 as may be provided in flush mount spider assembly 110 for use with a rotary table disposed on the rig floor. Gripping module 54 may replace the master bushing in the rotary table on the rig floor. For different types of rotary tables, adapters may be used. Depending on the type of rotary table, a flush mount gripping module 54 may be substantially inserted within the rotary table but upper portions thereof such as upper housing 100 and parts of bowl section 74 may or may not extend above the rig floor. As with slip-type elevator 50, significant weight must be supported by flush mount assembly 110. In flush mount assembly 110 using National rotary table 114, shoulder 60 of gripping module 54 engages upper surface 122 of National rotary table 114 adjacent bore 124 that extends through the rotary table to the wellbore. One or more bolts or other fasteners, such as bolt 126, may be used to further secure gripping module 54 to the rotary table. For use with other rotary tables such as Continental rotary table 112, an adapter 128 may preferably be provided. In this configuration, weight from shoulder 60 is transferred to the adapter shoulder 130 which then applies the weight to the rotary table and/or rig floor.

The split view of FIG. 3 also shows slips 78 in a retracted or released position as at 116 and an extended or gripping position as at 118. It will be noted that the gripping module 54 of FIG. 3 for use as spider assembly 110 is identical or substantially identical to gripping module 54 of FIG. 2 so that gripping modules 54 are conveniently and economically interchangeable with respect to each other.

Figure 4:
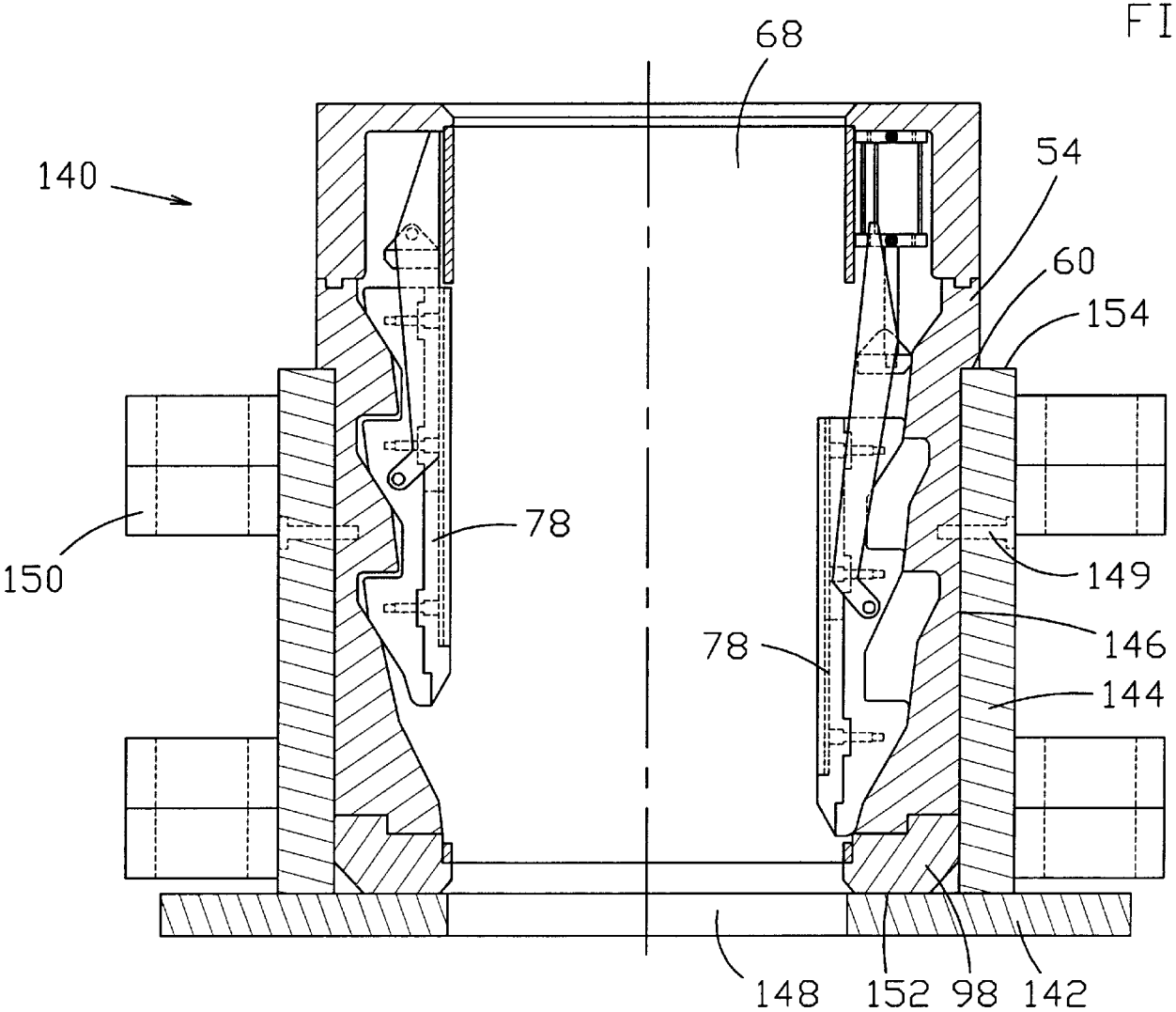
FIG. 4 is a split elevational view, in section, of a top mounted interchangeable gripping module.

FIG. 4 shows one possible top mount spider arrangement 140 using the same or another gripping module 54. Top mount spider arrangement 140 is designed to set on top of the rotary table when the rotary is of a size and/or construction other than those for which gripping module 54 is designed for or may otherwise be adapted to for flush mount purposes. Base member 142 may be secured to the rotary table and/or rig floor. Top mount body 144 preferably defines bore 146, which as also shown in the above embodiments, receives a preferably cylindrical portion of gripping module 54. One or more bolts or other fasteners, such as bolt 149, may be used to secure gripping module 54 within top mount body 144. Bore 68 extends through gripping module 54 and leads to the wellbore through bore 148 in base member 142 and the hole in the rotary table. Top mount spider arrangement 140 supports the significant weight of the casing string which may be held by slips 78. Base 142 supports lower ring 98 at surface 152. Support surface 154 supports shoulder 60 of gripping module 54. Support arms 150, which may be of various construction, may be used for positioning, mounting, and/or convenient lifting as desired of top mount spider arrangement 140. In one embodiment, top mount body 144 could also be used either with the elevators or as a top mount for added redundancy when a top mount spider construction is used.

Figure 5:
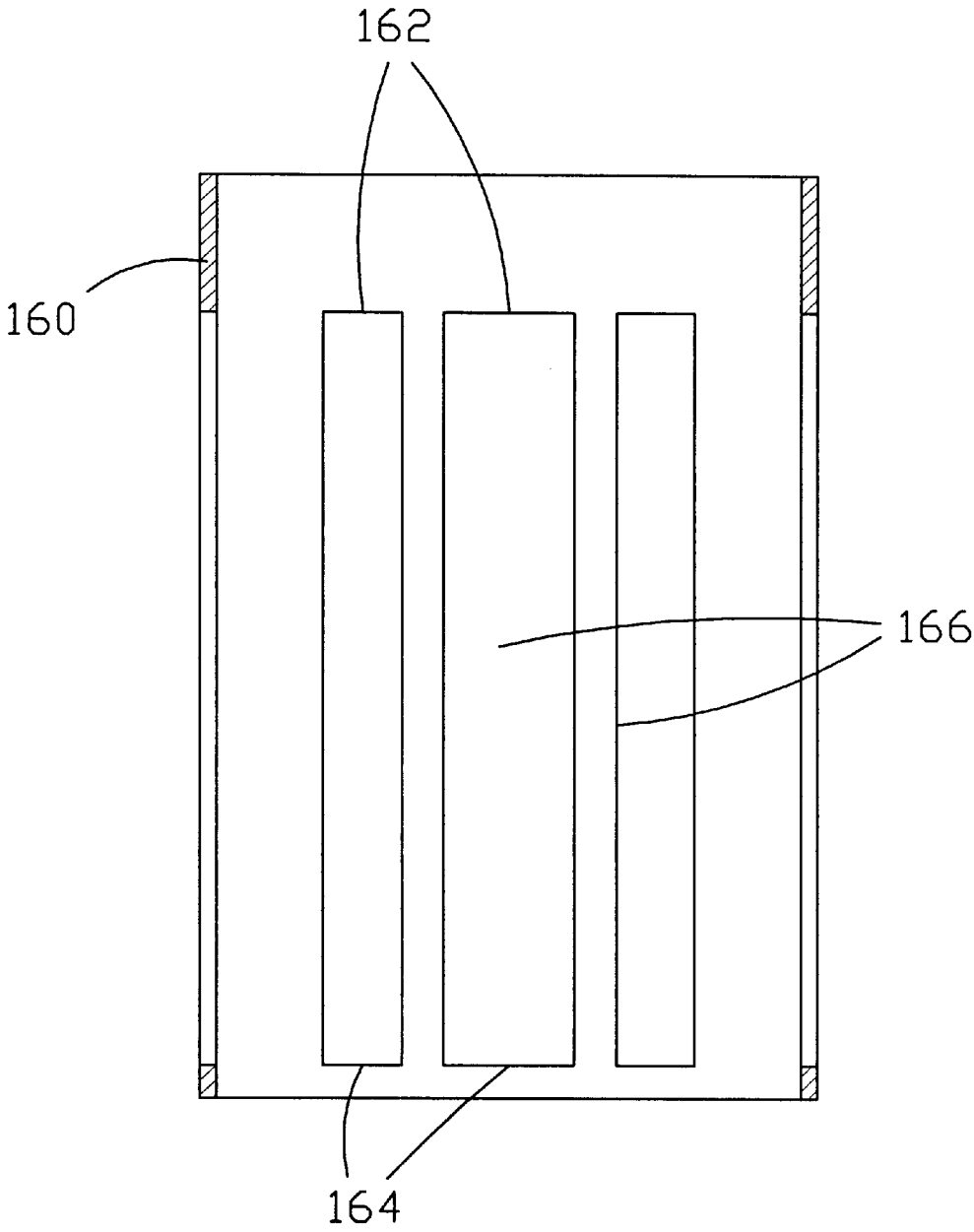
FIG. 5 is an elevational view, of a shroud used for guiding the pipe within the interchangeable gripping module of the present invention.

FIG. 5 shows shroud 160 used in guiding the casing string through gripping module 54. Shroud 160 and the top 162 and bottom 164 of windows 166 are shown most clearly in FIG. 5 although the respective top 162 and bottom 164 are also indicated in FIG. 2A, FIG. 3, and FIG. 4. Slips 78 extend through windows 166 in the engaged position for gripping the casing as discussed above. In the disengaged or open position, slips 78 are flush or slightly recessed with respect to shroud 160.

The interchangeability of gripping modules 54 with each other for use as either an elevator slips or a spider is one of the significant advantages of the present invention. In operation, when the tool handling system of the present invention is sent on a job, three gripping modules 54 will be provided with one elevator module, such as elevator module 52 discussed above. If required, an additional one top mount module is also provided. Since only two gripping modules 54 will actually be used at any one time, the third gripping module 54 will provide 100% redundancy for the spider and the elevator without the need for a fourth tool. This reduces the equipment required by approximately 25% to provide a significant economy for both the vendor and the customer. Moreover, the construction disclosed herein with three internal load rings and long heavy-duty slips allows the handling system of the present invention to handle large loads even with thin wall tubulars without crushing them.

The present invention is effectively a three-in-one handling tool system. The modular tool system can be used as a: 1) flush mount spider; 2) a top mount spider; and/or 3) a slip-type elevator. To briefly summarize, the tool system consist of a split bow module, such as gripping module 54, that includes the slips and the slip operating mechanism. An elevator module, such as elevator module 52, is provided. A top mount module, such as top mount body 144, may also be provided as necessary for providing a top mount spider construction. The gripping or split bowl module 54 will fit into the rotary table or elevator module 52 or top mount body 144. Thus, each split bowl or gripping module 52 can be utilized for three separate functions. Elevator module 52 mimics the rotary table bore so as to contain the split bowl or gripping module 54 and has integral lifting ears 70 to enable it to function as an elevator. Top mount body 144 is designed to set on top of the rotary table when the rotary is of a size other than the one the gripping module 54 was preferably designed for. Top mount body 144 also mimics the function of the rotary table in constraining the bowl or gripping module 54 and may or may not be made with an integral baseplate, such as baseplate 142.

The foregoing disclosure and description of the invention is illustrative and explanatory thereof, and it will be appreciated by those skilled in the art, that various changes in the size, shape and materials, the use of mechanical equivalents, as well as in the details of the illustrated construction or combinations of features of the various three-in-one elements may be made without departing from the spirit of the invention.

What is claimed is:

1. A handling system for holding and lowering wellbore tubulars for use with a rig having a traveling block and a rig floor, said system comprising:

at least two gripping modules, said at least two gripping modules being substantially identical so as to be interchangeable with each other, said at least two gripping modules each having a bowl section, said at least two gripping modules each having a plurality of slips moveable within said bowl section; and an elevator adapter, said elevator adapter having at least one connector for coupling to said traveling block, said elevator adapter being attachable to either one of said at least two gripping modules with a remaining of either one of said at least two gripping modules being attachable to said rig floor.

2. The handling system of claim 1, further comprising a third gripping module for use in substituting with either of said at least two gripping modules.

3. The handling system of claim 1, wherein said elevator adapter defines a bore therein for receiving either one of said at least two gripping modules.

4. The handling system of claim 1, wherein said at least one connector for said elevator adapter further comprises lifting elements.

5. The handling system of claim 1, further comprising a top mount module, said top mount module being mountable to said rig floor, said top mount module being attachable to either of said at least two gripping modules.

6. The handling system of claim 5, further comprising a top mount body, said top mount body defining a bore therein for receiving either of said at least two gripping modules.

7. The handling system of claim 1, wherein said at least two gripping modules have a weight supporting shoulder extending radially outwardly for supporting a weight of said wellbore tubulars.

8. The handling system of claim 7, further comprising an elevator engagement surface for contacting said weight supporting shoulder of either of said at least two gripping modules.

9. The handling system of claim 1, wherein said plurality of slips are longitudinally moveable within each of said at least two gripping modules, and a sloping bottom surface within each of said at least two gripping modules angled with respect to an axis through each of said at least two gripping modules, said sloping surface forming a stop surface for supporting and preventing further longitudinal movement of said plurality of slips toward a gripping position.

10. The handling system of claim 1, further comprising a plurality of rings within each of said at least two gripping modules, and said plurality of slips for each of said at least two gripping modules with each said slip having a substantially sawtooth profiled set of camming surfaces for camming engagement with said plurality of rings.

11. A method for a wellbore tubular handling system for installing wellbore tubulars in a wellbore, said wellbore tubular handling system being used with a traveling block supported by a rig, said rig having a rig floor, said method comprising:

providing at least two gripping modules for gripping wellbore tubulars, said at least two gripping modules being interchangeable with respect to each other;

selecting either of said at least two gripping modules for attachment to said traveling block; and selecting either of said at least two gripping modules for attachment to said rig floor.

12. The method of claim 11, further comprising supplying at least three gripping modules for gripping wellbore tubulars such that said at least three gripping modules are interchangeable for attachment to one of said traveling block and said rig floor, one of said at least three gripping modules providing redundancy for the remaining gripping modules.

13. The method of claim 11, wherein said attachment to said traveling block further comprises providing an elevator module for interconnection between said traveling block and either of said at least two gripping modules.

14. The method of claim 11, wherein said attachment to said rig floor further comprises a top mount module for interconnection between said rig floor and either of said at least two gripping modules.

15. The method of claim 11, wherein said attachment to said rig floor further comprises a flush mount adaptor ring for interconnection between said rig floor and either of said at least two gripping modules.

16. A method for a wellbore tubular handling system for installing wellbore tubulars in a wellbore, said wellbore tubular handling system being used with a traveling block supported by a rig, said rig having a rig floor, said method comprising:

providing at least three gripping modules that are substantially identical so as to be interchangeable with each other;

supplying said rig with said at least three gripping modules; and supplying said rig with a tool for attaching any one of said three gripping modules for use with said traveling block.

17. The method of claim 16, further comprising utilizing a first of said at least three gripping modules for attachment to said traveling block, utilizing a second of said at least three gripping modules for attachment to said rig floor, and utilizing a third of said at least three gripping modules to provide redundancy for said first and second of said at least three gripping modules.

18. A handling system for holding and lowering wellbore tubulars for use with a rig having a traveling block and a rig floor, said system comprising:

a plurality of substantially identical gripping modules, each of said plurality of gripping modules being interchangeable with respect to each other;

a first of said plurality of substantially identical gripping modules being mountable to said traveling block; and a second of said plurality of substantially identical gripping modules being mounted such that said traveling block is translationally moveable with respect thereto for cooperation with said first of said plurality of substantially identical gripping modules in holding and lowering said wellbore tubulars.

19. The handling system of claim 18, further comprising an elevator module for receiving said first of said plurality of substantially identical gripping modules, said elevator module having at least one connector for attachment with said traveling block.

20. The handling system of claim 18, further comprising a top mount module for receiving said second of said plurality of substantially identical gripping modules for fixable mounting with respect to said rig floor.

21. The handling system of claim 18, further comprising a plurality of slips longitudinally moveable within each of said plurality of substantially identical gripping modules, and a sloping bottom surface within each of said plurality of substantially identical gripping modules angled with respect to an axis through each of said plurality of substantially identical gripping modules, said sloping surface forming a stop surface for supporting and preventing further longitudinal movement of said plurality of slips toward a gripping position.

22. The handling system of claim 18, further comprising a plurality of rings within each of said plurality of substantially identical gripping modules, and a plurality of slips for each of said plurality of substantially identical gripping modules with each said slip having substantially sawtooth set of camming surfaces for camming engagement with said plurality of rings.

23. The handling system of claim 18, further comprising an elevator/top mount module, said elevator/top mount module being connectable to one of said rig floor and said traveling block, said elevator/top mount module receiving either said first or said second of said plurality of substantially identical gripping modules.

24. The handling system of claim 18, wherein each of said gripping modules further comprise a shroud therein for guiding said wellbore tubulars.

25. The handling system of claim 24, further comprising a plurality of windows in said shroud.

26. The handling system of claim 25, further comprising a plurality of slips for each gripping module, each of said plurality of slips being extendable through a respective of said plurality of windows.

* * * * *